United States Patent [19]

King et al.

[11] 4,404,424

[45] Sep. 13, 1983

[54] SHIELDED TWISTED-PAIR FLAT ELECTRICAL CABLE

[75] Inventors: William A. King, Aurora; John W. Kincaid, Batavia, both of Ill.

[73] Assignee: Cooper Industries, Inc., Houston, Tex.

[21] Appl. No.: 311,524

[22] Filed: Oct. 15, 1981

[51] Int. Cl.[3] ..... H01B 7/08; H01B 11/06; H01B 11/10

[52] U.S. Cl. ..... 174/34; 174/32; 174/36; 174/117 F

[58] Field of Search ..... 174/32, 34, 36, 117 F

[56] References Cited

U.S. PATENT DOCUMENTS

| | | | |
|---|---|---|---|
| 3,032,604 | 5/1962 | Timmons | 174/115 |
| 3,582,532 | 6/1971 | Plummer | 174/36 |
| 3,612,743 | 10/1971 | Angele | 174/36 |
| 3,663,739 | 5/1972 | Chevier | 174/36 |
| 3,736,366 | 5/1973 | Wittenberg | 174/34 |
| 3,757,029 | 9/1973 | Marshall | 174/36 |
| 3,775,552 | 11/1973 | Schumacher | 174/105 R |
| 4,034,148 | 7/1977 | Lang | 174/34 |
| 4,096,346 | 6/1978 | Stine et al. | 174/36 |
| 4,234,759 | 11/1980 | Harlow | 174/104 |
| 4,287,385 | 9/1981 | Dombrowsky | 174/36 |
| 4,297,522 | 10/1981 | Jesse et al. | 174/36 |
| 4,327,246 | 4/1982 | Kincaid | 174/36 |

FOREIGN PATENT DOCUMENTS

| | | | |
|---|---|---|---|
| 2709129 | 8/1978 | Fed. Rep. of Germany | 174/34 |
| 134160 | 2/1979 | Fed. Rep. of Germany | 174/117 |

*Primary Examiner*—A. T. Grimley
*Assistant Examiner*—Morris H. Nimmo
*Attorney, Agent, or Firm*—Fitch, Even, Tabin & Flannery

[57] ABSTRACT

A shielded flat electrical cable is formed of a plurality of twisted pairs of conductors. Individual conductors of each conductor pair are twisted about each other for at least one portion of their mutual length. The conductors are laminated to a film to maintain predetermined spacing and the electrical parameters of the cable. In a preferred embodiment, the shielding comprises a wider and a narrower tape, each having a conductive layer and an insulating strength-giving layer. The tapes are disposed on opposite sides of the core of the cable. The wider tape wraps around the edges of the core and overlies portions of the narrower tape so as to make electrical contact therewith, avoiding a slot effect.

5 Claims, 3 Drawing Figures

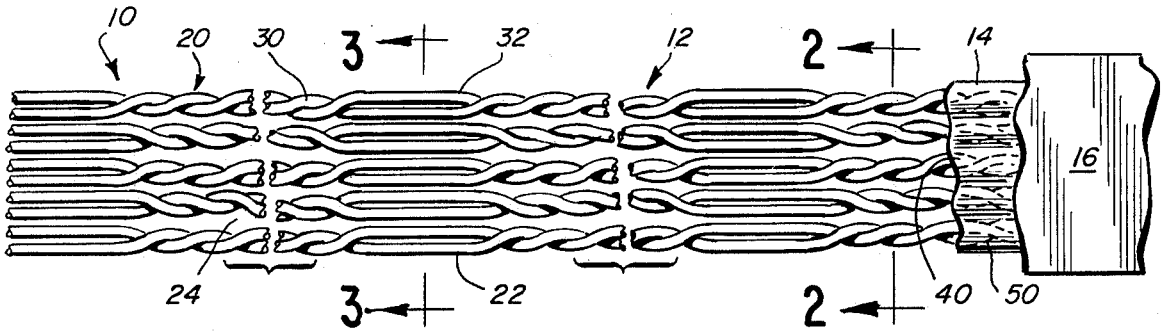
FIG. 1
FIG. 2
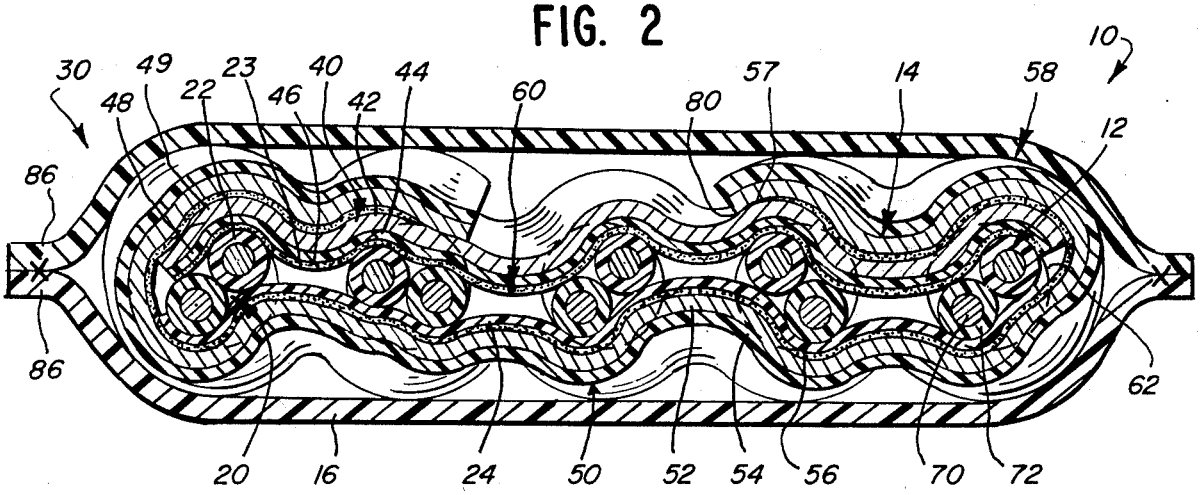
FIG. 3
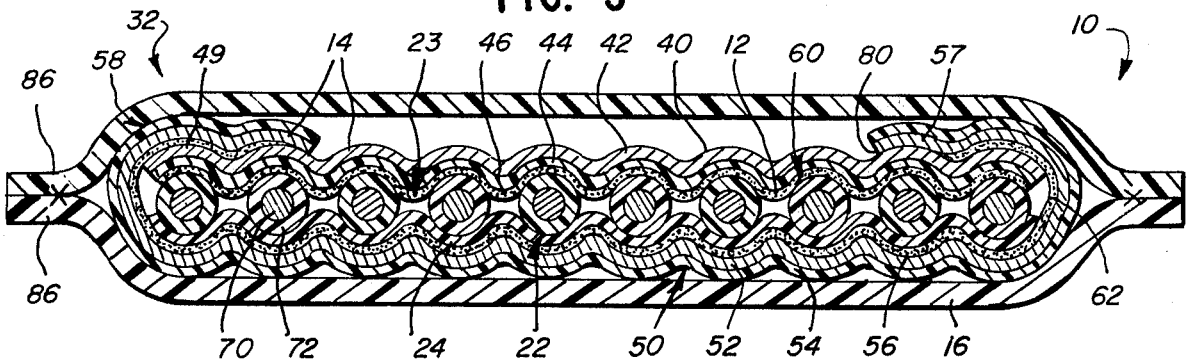

SHIELDED TWISTED-PAIR FLAT ELECTRICAL CABLE

BACKGROUND OF THE INVENTION

The present invention relates to a flat electrical cable and in particular to a shielded twisted pair flat electrical cable.

Flat electrical cables are increasingly employed as information processing requirements include the parallel transport of several signals from one component to another. Communications, data processing and other applications require precise control over electrical characteristics such as impedance, capacitance, cross talk and attenuation. In particular it is necessary to isolate individual conductors and circuit pairs from extraneous electrical fields and to minimize signal loss from the circuit pairs.

One approach to limiting signal loss and distortion is to shield individual conductors or circuit pairs. A variant of this approach is disclosed by Harlow in U.S. Pat. No. 4,234,759 and by Schumacher in U.S. Pat. No. 3,775,552, in the form of ribbon-shaped assemblies of minature coaxial cables. A disadvantage of individual shielding is that it is expensive.

A more economical approach is to shield the flat cable conductors as an entirety as disclosed by Angele et al in U.S. Pat. No. 3,612,743. A disadvantage of this approach is that cross talk between adjacent conductor pairs with the flat cable is not inhibited.

Another economical approach is to form twisted conductor pairs so as to cancel distorting influences upon each circuit pair. The disadvantages of this approach include limited effectiveness of the cancellation and high attenuation due to lack of means to prevent signal loss. Further it is known to include sections of untwisted conductors periodically in flat cables to facilitate connections. It is also known to provide accurate spacing of the conductors of flat electrical cables so that critical electrical parameters such as inductance and capacitance can be controlled, as disclosed by Lang in U.S. Pat. No. 4,034,148, wherein the insulated conductors or twisted pairs are laminated between plastic films.

Accordingly, it is a primary object of the present invention to provide an improved economical cable with low attenuation and good resistance to signal distortion and which permits precise control over electrical parameters.

SUMMARY OF THE PRESENT INVENTION

A shielded twisted pair flat electrical cable is presented having a core, a shielding and a protective sheath surrounding the shielded core. The core comprises a ribbon-shaped assembly of pairs of insulated conductor wires, the conductor wires of each pair being twisted about each other for at least one portion of their mutual longitudinal extent. In one preferred embodiment, the conductor pairs alternate twisted and straight portions. In an alternate embodiment the twisting extends over the entire length of the cable.

In the certain embodiments, the spacing between conductor pairs is provided by laminating them to one side of a single plastic sheet. In one preferred embodiment, the plastic film is laminated to the conductors prior to the adding of the shielding; in this embodiment the film may be considered part of the core. In an alternative embodiment, the plastic film is part of the shielding and is laminated to the conductor wires as the shielding is applied to the core.

The shielding comprises a conductive layer completely surrounding the core. Normally the conductive layer is associated with a backing layer of insulating material, so means are provided for eliminating a potential slot effect. The elimination of the slot effect may be accomplished by a shorting fold at one edge of a shielding tape to form an electrical connection where the tape overlaps itself. However, in a preferred embodiment, the shielding comprises two tapes, one covering one side of the core and the other covering the other side. One of the tapes overlies the other near each edge of the core; the overlying tape has its conductive layer toward the core and the underlying tape has its conductive layer away from the core so that the tapes contact each other electrically to avoid a slot effect. Preferably, both tapes are bonded to the core to conform closely to the contours of the conductor wires. The close conforming of the shielding to the core helps to maintain close control over the electrical parameters of the cable.

A protective insulating sheath may be laminated or extruded over the shielding to complete the cable. The shielding limits signal loss from the cable while isolating the conductor wires from the effects of electromagnetic fields external to the cable. The twisting of the circuit pairs supplements the shielding by cancelling cross talk between conductor pairs within the cable. The laminated plastic film preserves the spacing of the pairs, and the bonding of the shielding helps maintain precise control over the electrical parameters of the cable. Thus, an economical and improved flat electrical cable is presented which limits signal attenuation and distortion and provides precise control over the electrical parameters of the cable.

BRIEF DESCRIPTION OF THE DRAWINGS

FIG. 1 is a plan view of a flat shielded cable in accordance with the present invention, with portions of the sheath and shielding broken away.

FIG. 2 is a vertical sectional view of the cable shown in FIG. 1, taken along line 2—2 of FIG. 1.

FIG. 3 is a vertical sectional view of the cable shown in FIG. 1, taken along line 3—3 of FIG. 1.

DESCRIPTION OF THE PREFERRED EMBODIMENTS

A shielded twisted-pair flat electrical cable 10 is presented having a core 12, a shielding 14 and a protective sheath 16 surrounding the core. The core 12 comprises a ribbon-shaped assembly of side-by-side pairs 20 of insulated conductor wires 22, the conductor wires of each pair being twisted about each other for at least one portion of their mutual length. The twisting limits distortion due to cross talk such as might otherwise be induced by adjacent pairs 20 of wires. Preferably, the conductor pairs are laminated to one side of a plastic film 24 to maintain predetermined conductor spacing to help control the electrical parameters of the cable such as inductance and capacitance.

The shielding 14 provides a conductive enclosure for the cable core 12 to insulate it from electromagnetic fields orginating outside the shielding and to limit signal leakage from the enclosed core. Preferably, the shielding closely conforms to the core surfaces to better maintain the electrical parameters of the cable which might otherwise be altered during flexing of the cable. In the illustrated embodiment, the shielding 14 is bonded to the core 12 to ensure conformity. The closely conforming shielding, dipping as it does at least part way between adjacent conductor pairs 20 (and between adjacent conductors 22 in the untwisted portions) provides a limitation to cross talk between conductors 22 in addition to that provided by twisting the wires.

In the cable 10 of the illustrated embodiment, the conductor pairs 20 have alternate twisted portions 30 and straight portions 32. Adjacent pairs are preferably twisted in counter rotation to one another to further minimize electrical coupling therebetween. The straight portions permit more ready termination and connection of the cable 10.

The conductor pairs 20 are laminated to one side of the plastic film 24, which may be of polyvinyl cloride (PVC), in such manner that the film conforms to some extent to the adjacent portions of the insulated conductor wires 22 so that the film is not entirely flat. The film serves to fix the relative positions of the conductor wires so that the electrical parameters of the cable 10 are maintained.

The shielding 14 completely surrounds the core 12, including the laminated film 24. In the illustrated embodiment, the shielding 14 comprises two tapes, a narrower tape 40 and a wider tape 50. Each tape 40, 50 has a conductive layer 42, 52 and a strength-giving backing 44, 54 of insulating material. The narrower tape 40 has approximately the same width as the core 12 and, as illustrated, is disposed against and coextensive with the side 60 of the core opposite the laminating film 24. The conductive layer 42 is opposite the core 12 while the backing 44 is bonded to the adjacent insulated conductor surfaces 23 with an adhesive 46, such as ethyl acrylic acetate. The narrower tape 40 closely conforms to the adjacent surfaces 23 so as to extend to some degree between adjacent conductors 22 and conductor pairs 20, providing additional protection against cross talk between pairs within the cable 10.

The wider tape 50 is disposed against the laminating film 24, the edges 62 of the core 12, and edge regions 48 of the narrower tape 40. The longitudinal median of the wider tape 50 and the core are aligned, and the width of the wider tape is less than twice the width of the core so that the two regions of overlap 58 of the wider tape are of approximately equal width. The conductive layer 52 of the wider tape 50 is bonded to the laminated film 24, the core edges 62 and to a portion 49 of the conductive layer 42 of the narrower tape 60 with an adhesive 56 such as ethyl acrylic acetate. However, a portion 57 of the conductive layer 52 of the wider tape 50 adjacent its edges is not bonded so that electrical contact is made between the tapes adjacent both core edges 62, thereby avoiding a slot effect in the shielding, as would be occasioned by a gap in the shielding. The wider tape 50 is bonded so as to closely conform to the adjacent film 24 and indirectly to the conductor wire surfaces 23 adjacent the film 24. Again, the conformity helps maintain the electrical parameters of the cable 10 and helps to minimize cross talk between the conductors pairs 20.

The protective sheath 16 may be extruded or laminated at the edges over the shielded core to provide integrity and environmental protection to it.

Describing the illustrated embodiment with greater specificity, the core contains five pairs 20 of insulated conductors 22 with alternating twisted 30 and straight portions 32. The twisted portions 30 are 18.0±0.5" long and have a nominal width of 0.50" and a nominal thickness of 0.080". The pairs 20 are arranged on a nominal pitch of 0.100". The straight portions 32 are 2.0±0.25" long, 0.45±0.015" wide and 0.042±0.003" thick; the individual conductors are arranged on a pitch of 0.050±0.005". The individual conductors are stranded copper, 28 AWG (7×36), with a nominal diameter of 0.015". The insulation 72 of the wire, preferably PVC, is 0.010" thick, so the insulated conductors 22 have a diameter of 0.035", approximately. Of course, these dimensions may be varied; in particular, different numbers of conductors may be selected and the core width varied accordingly.

The laminated film 24 is preferably of PVC. The laminated film may be applied just prior to the shielding. Alternatively, the laminated film may be part of the shielding, a strip of PVC along the center of the conductive layer of the wider tape or the backing layer of the narrower tape. The film of the illustrated embodiment is 0.010" thick and 0.5" wide.

The shielding 14 surrounds the core 12 so as to limit signal leakage therefrom and to block electromagnetic interference with the signals conveyed by the cable 10. Preferably, the shielding 14 comprises a completed circuit about the core to avoid the slot effect. In the preferred embodiment, the shielding comprises two tapes 40 and 50, each with an aluminum conductive layer 42, 52 and a polyester or polypropylene backing 44, 54. The narrower tape 40 has the adhesive coating 46 on the backing layer 44. The coating is preferably a heat-sensitive adhesive such as ethyl acrylic acetate. The narrower tape 40 is disposed with the adhesive side against the side 60 of the core opposite the laminated film 24 and the conductive layer 42 away from the core 12.

The wider tape 50 has the adhesive coating 56 covering the central portion of the conductive layer 52. Preferably, this coating is also a heat-sensitive adhesive such as ethyl acrylic acetate so that bonding can be effected during the extrusion or lamination of the protective sheath 16. The width of the adhesive coating 56 is greater than the width of the core 12 but less than the width of the wider tape 50 so that the tape 50 can be bonded around the edges 62 of the core without preventing the slot closing electrical connections 80 between the narrower and wider tapes adjacent the edges 62 of the core 12. In the illustrated embodiment, the wider tape is about 0.75" wide and the adhesive coating 56 is about 0.65" wide.

The shielding tapes 40 and 50 are conformed closely to the contours of the core 12. The narrower tape 40 may be tucked between the cable pairs 20 to provide better control over cable parameters and additional protection against cross talk within the cable 10. The wider tape 50 conforms less closely because the laminating film 24 softens the contours somewhat; nonetheless, the wider tape 50 can be conformed to an extent to provide additional shielding against cross talk within the cable. More importantly, the close conforming shielding 14 provides more precise control over the electrical parameters of the cable 10. In other words, a loosely positioned shielding would create more variations in shielding-to-conductor wire distances and thereby alter the capacitance and inductance of the cable in haphazard fashion.

The protective sheath 16 of the preferred embodiment comprises two 0.05" thick strips 86 which are 0.9" wide and laminated together at their respective edges. The sheath may or may not be closely conformed to the shielding. Some air space between the sheath and the shielding may facilitate removal of the sheath for purposes of terminating and/or connecting the cable.

Many alternative embodiments of the present invention are contemplated. The various dimensions may be altered to fit particular applications. The cable pairs may be twisted along their entire lengths, or along portions of their lengths. Different materials may be employed as context dictates. These and other variations are possible and in the spirit and scope of the present invention.

What is claimed is:

1. A flat multi-conductor electrical cable comprising:

a plurality of unshielded pairs of unshielded insulated conductor wires, said pairs extending substantially side-by-side longitudinally along the cable and parallel to one another, the individual wires of each said pair being twisted about one another for at least one portion of their mutual length;

a shielding member including a conductive layer substantially surrounding collectively said plurality of pairs of insulated conductor wires and closely conforming to said pairs of insulated wires so as to extend part way between adjacent said pairs of insulated conductors, said shielding member being bonded to said conductor wires; and a sheath of insulating material encasing said shielding member and said plurality of pairs of insulated conductor wires.

2. A flat multi-conductor electrical cable comprising:

a film of laminating material;

a plurality of unshielded pairs of unshielded insulated conductor wires bonded to said film so that predetermined spacing between said pairs is maintained, said film and said pairs of insulated conductor wires extending longitudinally along the cable, said pairs of insulated conductor wires extending substantially side-by-side parallel to one another, the individual wires of each said pair being twisted about one another for at least one portion of their mutual length;

a shielding member including a conductive layer substantially surrounding collectively said film and said plurality of pairs and closely conforming to said pairs of insulated wires so as to extend part way between adjacent said pairs of insulated conductors, said shielding member being bonded to said film and said conductor wires; and a sheath of insulating material encasing said shielding member and said plurality of pairs of insulated conductor wires.

3. A flat multi-conductor electrical cable comprising:

a plurality of unshielded pairs of unshielded insulated conductor wires, said pairs extending substantially side-by-side longitudinally along the cable and parallel to one another so as to define a ribbon with a first side, a second side, and two parallel edges, the individual wires of each said pair being twisted about one another for at least one portion of their mutual length;

a laminating film bonded to said first side of said ribbon so as to maintain the spacing of said pairs of insulated conductor wires and thereby contribute to the stability of the electrical parameters of the cable, said film having substantially the same width as and being coextensive with said ribbon;

a narrower shielding tape including a conductive layer and a backing layer, said narrower tape being disposed against and coextensively with said second side of said ribbon, said backing layer being bonded to said second side, said narrower tape closely conforming to the contours of said second side defined by said pairs of insulated conductor wires;

a wider shielding tape including a conductive layer and a backing layer, said wider tape having a width greater than that of said ribbon and less than twice that of said ribbon, said wider tape being disposed against the side of said laminating film opposite said pairs of insulated conductor wires, against said edges of said ribbon and portions of said narrower shielding tape adjacent the edges of said ribbon, said conductive layer of said wider tape being bonded to said laminating film and said narrower tape, edge regions of said wider tape electrically contacting said conductive layer of said narrower tape along a substantially continuous longitudinal strip so as to avoid a slot effect, said wider tape conforming relatively closely to the adjacent contours defined by said pairs of insulated conductor wires; and a protective sheath encasing said wider and narrower shielding tapes, said laminating film and said plurality of pairs of insulated conductors so as to provide integrity and protection to the cable.

4. The cable of claim 3 further characterized in that said individual wires of each pair are twisted about one another for substantially their entire mutual length.

5. The cable of claim 3 further characterized in that said pairs of insulated conductor wires have alternating twisted and straight portions.

* * * * *

UNITED STATES PATENT AND TRADEMARK OFFICE

CERTIFICATE OF CORRECTION

PATENT NO. : 4,404,424

DATED : September 13, 1983

INVENTOR(S) : William A. King and John Kincaid

It is certified that error appears in the above-identified patent and that said Letters Patent is hereby corrected as shown below:

Column 1, line 29, insert a period (.) after "al".

Column 2, line 62, change "insulate" to --isolate--.

Column 3, line 15, change "cloride" to --chloride--.

Column 3, line 59, change "conductors" to --conductor--.

Column 3, line 68, after "on" insert --with--.

Column 4, line 1, change "pitch" to --spacing between centers of pairs--.

Column 4, line 3, change "on a pitch" to --with a spacing between centers--.

Signed and Sealed this

Sixth Day of March 1984

[SEAL]

*Attest:*

GERALD J. MOSSINGHOFF

*Attesting Officer*

*Commissioner of Patents and Trademarks*